US007214042B2

(12) United States Patent
Parrett

(10) Patent No.: US 7,214,042 B2
(45) Date of Patent: May 8, 2007

(54) PROGRESSING CAVITY PUMP WITH DUAL MATERIAL STATOR

(75) Inventor: Dale H. Parrett, Dayton, OH (US)

(73) Assignee: Moyno, Inc., Springfield, OH (US)

( * ) Notice: Subject to any disclaimer, the term of this patent is extended or adjusted under 35 U.S.C. 154(b) by 104 days.

(21) Appl. No.: 10/947,703

(22) Filed: Sep. 23, 2004

(65) Prior Publication Data

US 2006/0073032 A1 Apr. 6, 2006

(51) Int. Cl.
*F04C 18/00* (2006.01)
*F03C 2/00* (2006.01)

(52) U.S. Cl. ..... 418/48; 418/152; 418/178; 418/179

(58) Field of Classification Search ..... 418/48, 418/152, 153, 178, 179
See application file for complete search history.

(56) References Cited

U.S. PATENT DOCUMENTS

| | | | | |
|---|---|---|---|---|
| 2,512,764 | A * | 6/1950 | Byram | 418/48 |
| 2,612,845 | A * | 10/1952 | Byram et al. | 418/48 |
| 3,084,631 | A * | 4/1963 | Bourke | 418/48 |
| 3,139,035 | A | 6/1964 | O'Connor | |
| 3,435,772 | A | 4/1969 | Schlecht | |
| 4,681,260 | A | 7/1987 | Cochran | |
| 5,120,204 | A | 6/1992 | Mathewson et al. | |
| 5,145,342 | A * | 9/1992 | Gruber | 418/48 |
| 5,221,197 | A * | 6/1993 | Kochnev et al. | 418/48 |
| 5,722,820 | A | 3/1998 | Wild et al. | |
| 5,807,087 | A | 9/1998 | Brandt et al. | |
| 6,120,267 | A | 9/2000 | Cunningham | |
| 6,358,027 | B1 | 3/2002 | Lane | |
| 2002/0192093 | A1 | 12/2002 | Gantenhammer | |
| 2004/0126257 | A1 | 7/2004 | Lemay et al. | |

FOREIGN PATENT DOCUMENTS

| | | | | |
|---|---|---|---|---|
| DE | 4312123 | A1 * | 10/1994 | 418/48 |
| FR | 2826407 | A1 * | 12/2002 | 418/48 |
| GB | 2124305 | A * | 2/1984 | 418/48 |

* cited by examiner

*Primary Examiner*—Theresa Trieu
(74) *Attorney, Agent, or Firm*—Thompson Hine LLP

(57) ABSTRACT

A progressing cavity pump including a rotor and a stator having an inlet and an outlet. The rotor is rotationally disposed inside of the stator such that rotation of the rotor causes fluid in the pump to be pumped from the inlet toward the outlet in a downstream direction. The stator has an inner surface having a first portion made of a first material and a second portion made of a second material, the second portion being located in the downstream direction relative to the first portion.

45 Claims, 3 Drawing Sheets

PROGRESSING CAVITY PUMP WITH DUAL MATERIAL STATOR

The present invention is directed to a progressing cavity pump, and more particularly, to a progressing cavity pump having a stator made of more than one material.

BACKGROUND

Progressing cavity pumps typically have a single threaded screw, termed a rotor, located inside a stator having a double threaded cavity located therein. The rotor and the stator are shaped to create cavities along the length of the pump. As the rotor is rotated within the stator, the cavities progress from an inlet end of the pump to an outlet or discharge end. Thus, rotation of the rotor inside the stator pumps material located in the pump from the inlet end to the outlet end.

Stators may be formed of or coated with an elastomeric material to ensure a strong seal between the stator and rotor. The rotor and elastomeric stator form a compressive fit therebetween which allows the progressing cavity pump to self-prime, suction lift fluids (i.e. pump against gravity) and pump against a pressure (i.e., pump against a back pressure). However, stators lined with elastomeric material may have a performance disadvantage, especially when pumping moderate-to-high viscosity fluids due to pressure limitations of the elastomeric materials and frictional forces between the rotor and the stator.

Stators that are not lined with an elastomeric material (also known as "rigid stators") may be formed of relatively rigid materials such as steel. Progressing cavity pumps having rigid stators may have a gap or clearance between the rotor and the stator. The clearances between the rotor and stator reduce friction and allow for more efficient pumping of moderate viscosity fluids (i.e. having a viscosity of between about 3000 centipoise and about 20,000 centipoise) and high viscosity fluids (i.e. having a viscosity of greater than about 20,000 centipoise). In particular, when pumping moderate-to-high viscosity fluids, the viscous fluids fill the gaps or clearances between the rotor and stator to allow efficient pumping operations. However, the gap between the rotor and the stator may prevent the pump from being self-priming, can limit its ability to suction lift fluids, and may limit its volumetric efficiency, especially when pumping relatively low viscosity fluids (i.e. having a viscosity of less than about 300 centipoise, or less than about 100 centipoise, or between about 0.5 centipoise and about 100 centipoise).

Accordingly, there is a need for a progressing cavity pump, and in particular, a stator for use with a progressing cavity pump which can be self-priming, and can create sufficient suction and can pump against high pressure, while providing efficient pumping operations.

SUMMARY

The present invention is a progressing cavity pump, and in particular, a stator which can be used with a progressing cavity pump which can form a seal with the rotor yet provides high pumping efficiencies for moderate-to-high viscosity fluids. In particular, in one embodiment, the present invention is a hybrid stator having a relatively soft or elastomeric portion at one axial end and a rigid portion at the other axial end. The soft stator portion may be located at the inlet end of the stator to provide the desirable suction characteristics. The rigid stator portion may be located at the outlet end which allows high pumping pressures to be developed.

In particular, in one embodiment the invention is a progressing cavity pump including a rotor and a stator having an inlet and an outlet. The rotor is rotationally disposed inside of the stator such that rotation of the rotor causes fluid in the pump to be pumped from the inlet toward the outlet in a downstream direction. The stator has an inner surface having a first portion made of a first material and a second portion made of a second material, the second portion being located in the downstream direction relative to the first portion.

In another embodiment, the invention is a progressing cavity pump including a rotor and a stator having an inlet and an outlet. The rotor is rotationally disposed inside of the stator such that rotation of the rotor causes fluid in the pump to be pumped from the inlet toward the outlet in a downstream direction. The stator has an inner surface having a first portion having a material property and a second portion having a material property that differs from the material property of the first portion.

Other objects and advantages of the present invention will be apparent from the following description and the accompanying drawings.

DETAILED DESCRIPTION

Figure 1:
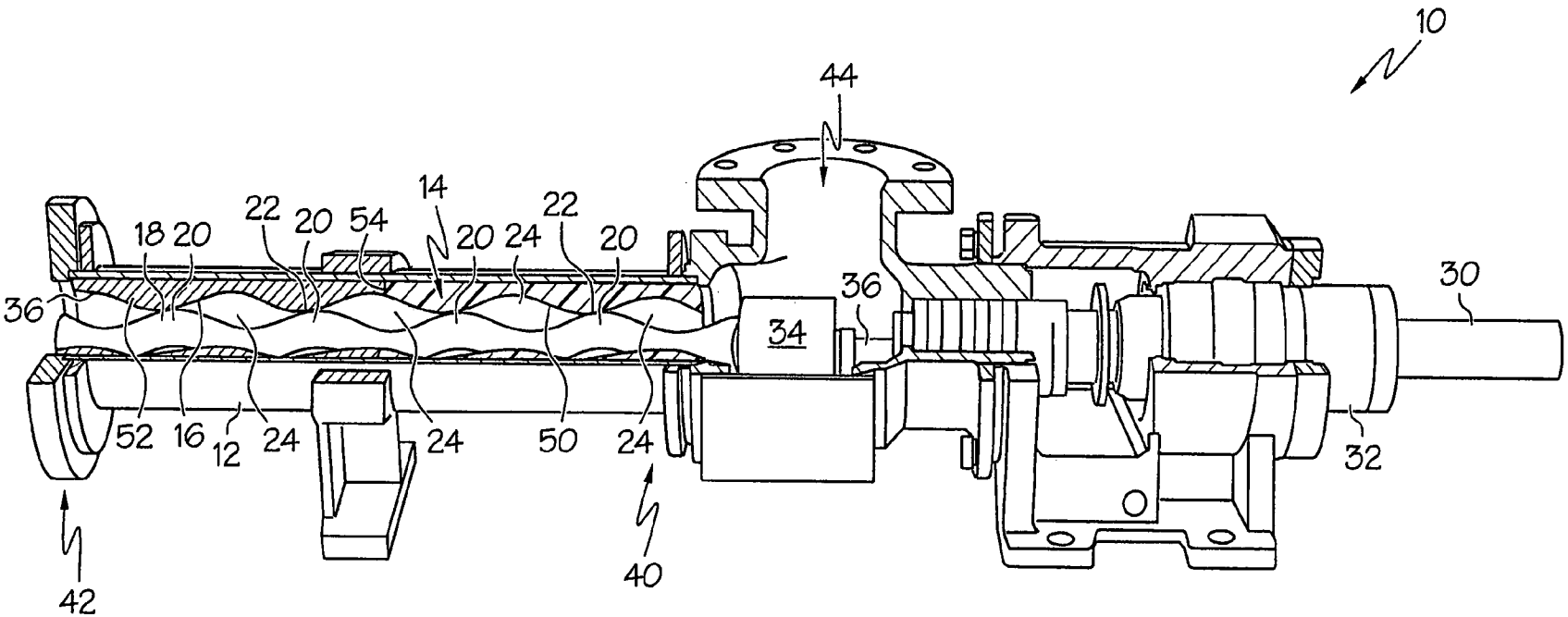
FIG. 1 is a front perspective view of one embodiment of the pump of the present invention, with portions of the pump cut away for illustrative purposes.

As shown in FIG. 1, the progressing cavity pump 10 of the present invention may include a generally cylindrical stator tube 12 having a stator 14 located therein. The stator 14 has an opening or internal bore 16 extending generally longitudinally therethrough in the form of a double lead helical nut to provide an internally threaded stator 14. The pump 10 includes an externally threaded rotor 18 in the form of a single lead helical screw rotationally received inside stator 14. The rotor 18 may include a single external helical lobe 20, with the pitch of the lobe 20 being twice the pitch of the internal helical grooves.

The rotor 18 fits within the stator bore 16 to provide a series of helical seal lines 22 where the rotor 18 and stator 14 contact each other or come in close proximity to each other. In particular, the external helical lobe 20 of the rotor 18 and the internal helical grooves of the stator 14 define the plurality of cavities 24 therebetween. The stator 14 has an inner surface 36 which the rotor 18 contacts or nearly contacts to create the cavities 24. The seal lines 22 define or seal off defined cavities 24 bounded by the rotor 18 and stator 14 surfaces.

The rotor 18 is rotationally coupled to a drive shaft 30 by a pair of gear joints 32, 34 and by a connecting rod 36. The drive shaft 30 is rotationally coupled to a motor (not shown). Thus, when the motor rotates the drive shaft 30, the rotor 18 is rotated about its central axis and thus eccentrically rotates within the stator 14. As the rotor 18 turns within the stator 14, the cavities 24 progress from an inlet or suction end 40 of the rotor/stator pair to an outlet or discharge end 42 of the rotor/stator pair. The pump 10 includes a suction chamber 44 in fluid communication with the inlet end 40 into which fluids to be pumped may be introduced. During a single 360° revolution of the rotor 18, one set of cavities 24 is opened or created at the inlet end 40 at exactly the same rate that a second set of cavities 24 is closing or terminating at the outlet end 42 which results in a predictable, pulsationless flow of pumped fluid.

The pitch length of the stator 14 may be twice that of the rotor 18, and the present embodiment illustrates a rotor/stator assembly combination known as 1:2 profile elements, which means the rotor 18 has a single lead and the stator 14 has two leads. However, the present invention can also be used with any of a variety of rotor/stator configurations, including more complex progressing cavity pumps such as 9:10 designs where the rotor has nine leads and the stator has ten leads. In general, nearly any combination of leads may be used so long as the stator 14 has one more lead than the rotor 18. U.S. Pat. Nos. 2,512,764, 2,612,845, and 6,120,267, the contents of which are hereby incorporated by reference, provide additional information on the operation and construction of progressing cavity pumps.

In the embodiment shown in FIG. 1, the stator 14 includes a first or upstream portion 50 made of a first material and a second or downstream portion 52 made of a second material. The first 50 and second 52 portions may abut against each other at a transition location 54, and are shaped and aligned such that the internal bore 16 transitions smoothly from the first portion 50 to the second portion 52 while maintaining a smooth and continuous helical nut shape. Thus, the first portion 50 extends from the inlet end 40 to the transition location 54, and the second portion extends from the transition location 54 to the outlet end 42. If desired, an O-ring (not shown) may be included in a groove (not shown) at the mating surfaces of the transition location 54 to seal the surfaces at the transition location 54.

Figure 3:
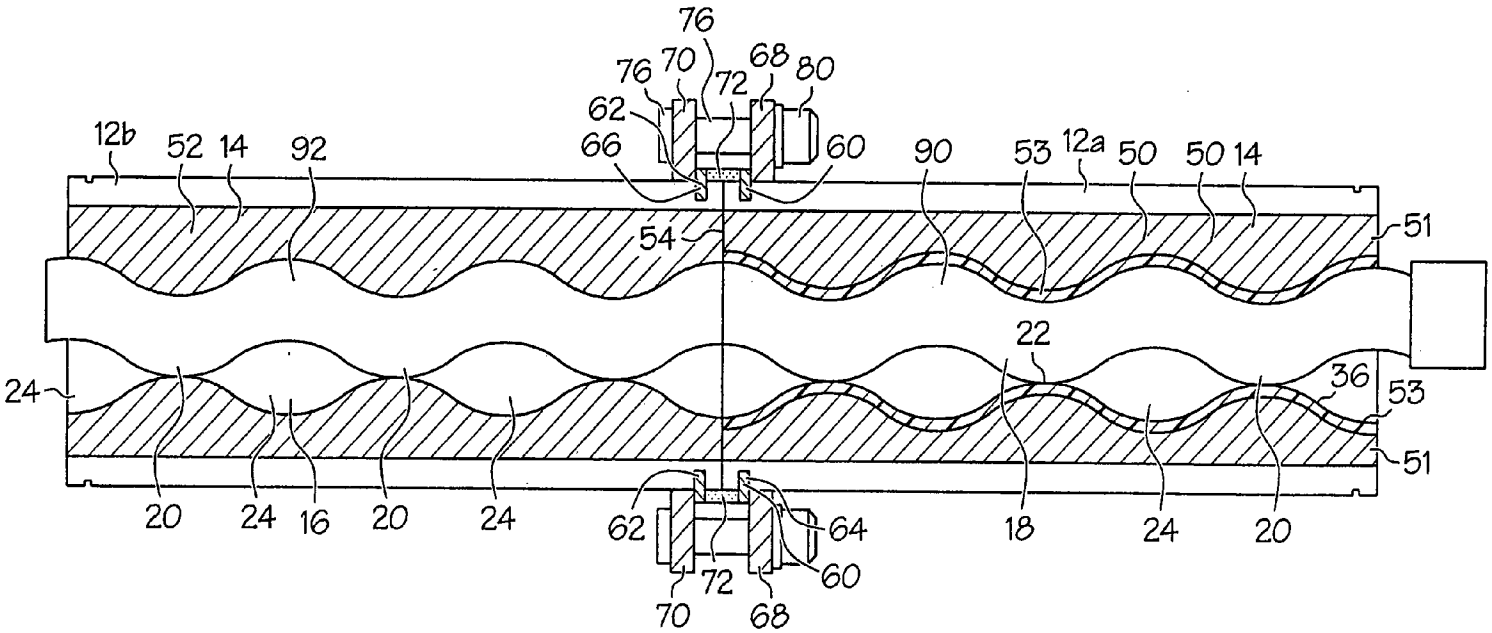
FIG. 3 is a side cross section of the stator of FIG. 2 with a rotor received therein.

The first portion 50 may be located at or adjacent to the inlet end 40 of the stator 16 and is made of a relatively soft material, such as elastomeric materials, elastomers, nitrile rubber, natural rubber, synthetic rubber, fluoroelastomer rubber, urethane, ethylene-propylene-diene monomer ("EPDM") rubber, polyolefin resins, perfluoroelastomer, hydrogenated nitrites and hydrogenated nitrile rubbers, polyurethane, epichlorohydrin polymers, thermoplastic polymers, polytetrafluoroethylene ("PTFE"), polychloroprene (such as Neoprene), synthetic elastomers such as HYPALON® polyolefin resins and synthetic elastomers sold by E. I. du Pont de Nemours and Company located in Wilmington Del., synthetic rubber such as KALREZ® synthetic rubber sold by E. I. du Pont de Nemours and Company, tetrafluoroethylene/propylene copolymer such as AFLAS® tetrafluoroethylene/propylene copolymer sold by Asahi Glass Co., Ltd. of Tokyo, Japan, acid-olefin interpolymers such as CHEMROZ® acid-olefin interpolymers sold by Chemfax, Incorporated of Gulfport Miss., and various other materials. The elastomeric material may have a hardness of between about 35 Shore A and about 85 Shore A, or less than about 35 Shore A, or less than about 85 Shore A, or more than about 85 Shore A Rather than being made entirely of a soft or elastomeric portion (as is the portion of the stator shown in FIG. 1), the first portion 50 may be made of a relatively rigid material, such as steel, with the relatively soft coating on its inner surface 36. For example, FIG. 3 illustrates the first portion 50 including a rigid (steel) inner core 51 with an elastomeric coating 53 located thereon. The helical groove of the stator portion 50 and/or the lobe 20 of the rotor 18 may be shaped and sized to form a compressive fit therebetween to allow the progressing cavity pump 10 to self-prime, suction, lift fluids and pump against a pressure (i.e., pump fluids against a back pressure).

The second portion 52 of the stator 14 may be located at or adjacent to the outlet end of the stator 42 and is made of a relatively rigid material, such as steel, carbon steel, tool steel, TEFLON® fluorinated hydrocarbons and polymers sold by E.I. duPont de Nemours and Company, A2 tool steel, 17-4 PH stainless steel, crucible steel, 4150 steel, 4140 steel or 1018 steel, or other suitable materials which can be cast or machined. The rigid stator material 52 may have a hardness of between about 25 Rockwell C or about 60 Rockwell C, or greater than about 25 Rockwell C or greater than about 60 Rockwell C. In this case, the helical groove of the second portion 52 and/or the lobe 20 of the rotor 18 may be sized somewhat differently from the first portion of the stator 50. In particular, the stator portion 52 and rotor 18 may have a gap or clearance therebetween, which provides high pumping efficiencies, especially for high viscosity fluids. The gap between the rotor 18 and stator portion 52 is relatively small, and thus is not shown in the attached drawings.

The bore 16 of the first stator portion 50 and the bore 16 of the second stator portion 52 may have the same size and shape, with the exception that the bore 16 of the first stator portion 50 may have an elastomeric coating on its inner surface 32 to provide a sealing surface. However, the size and shape of the bores 16 of the stator portions 50, 52 may vary from each other in order to provide optimal pumping performance inside each stator portion 50, 52. For example, as noted above, the bore 16 in the rigid stator portion 52 may be slightly larger than the bore 16 in the flexible stator portion 50.

The hybrid stator 14 of the present invention includes two portions 50, 52, which together allow for self-priming, suctioning, lifting fluids and pumping against a pressure, while also providing high pumping efficiencies for medium-to-high viscosity fluids. Accordingly, the hybrid stator 14 provides the advantages of both soft and rigid stators in a single stator, while limiting the drawbacks of either type of stator.

Figure 2:
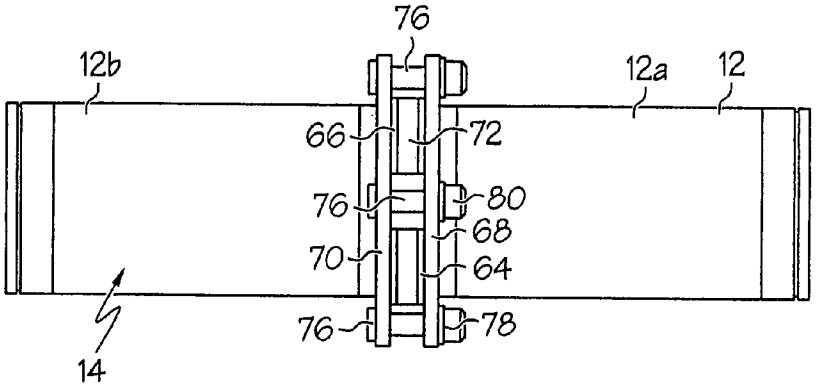
FIG. 2 is a side view of one embodiment of the stator of the present invention.
Figure 4:
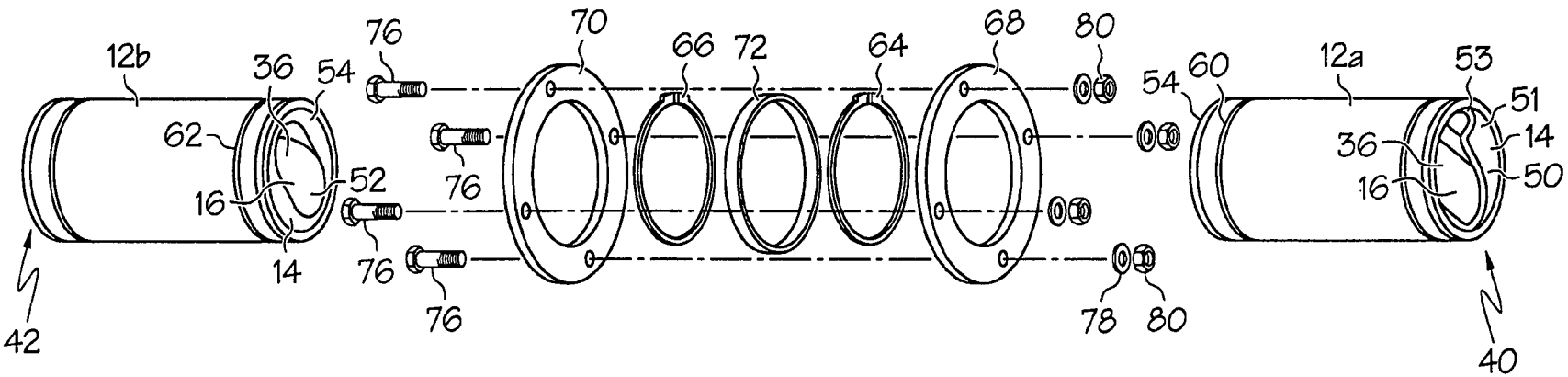
FIG. 4 is an exploded view of the stator of FIG. 2.

FIG. 1 illustrates a single stator tube 12 receiving two stator portions 50, 52 therein. FIGS. 2–4 illustrate an alternate embodiment of the hybrid stator 14 of the present invention, in which a first stator tube 12*a* receives the first stator portion 50 therein, and a second stator tube 12*b* receives the second stator portion 52 therein. The first and second stator tubes 12*a*, 12*b* may be joined together to form the hybrid stator 12. In this embodiment, providing two separate stator portions 50, 52 and tubes 12*a*, 12*b* which can be releasably joined together allows each separate stator section 50, 52 to be replaced, serviced and/or repaired without having to replace or access the entire hybrid stator.

In particular, a stator tube portion 12*a* which includes an elastomeric material on its inner surface will typically wear faster than a rigid stator tube portion 12*b*. Thus, stator tube portion 12*a* may need repair and/or replacement prior to stator tube portion 12*b*. Furthermore, the use of two separate stator portions 50, 52 which are joined together allows the stator bores 16 of each stator portion 50, 52 to be individually sized and shape to provide optimum pumping performance.

Any of a wide variety of methods for joining the two stator tubes 12*a*, 12*b* together may be utilized without departing from the scope of the present invention. However, in the illustrated embodiment, each stator tube 12*a*, 12*b* includes an annular recess 60, 62 located on its outer surface and adjacent to the transition location 54. The stator 12 may include a pair of retaining rings 64, 66, with each retaining ring received in an associated recess 60, 62. A clamp ring 68, 70 is located on either side of an associated retaining ring 64, 66, and a seal ring 72 is located between the seal rings 64, 66 and clamp rings 68, 70.

Bolts 76 are passed through the retaining rings 68, 70 and washers 78 and nuts 80 are located over the ends of the bolts 76 and tightened down to attach the first 12*a* and second 12*b* stator tubes in a sealed manner. The assembled hybrid stator 14 may then be utilized in a progressing cavity pump such as, for example, the pump shown in FIG. 1.

The hybrid stator 14 illustrated herein includes first 50 and second 52 stator portions of equal axial length. However, the relative lengths of the first 50 and second 52 portions may be adjusted in order to adjust the performance characteristics of the hybrid stator 14 in the desired manner. In other words, the transition location 54 may be located at any point along the length of the stator 14. Furthermore, if desired, more than two different types of materials may be included in the stator 12, or more than one material may be used at more than one location inside the stator 12.

Furthermore, the relatively hardness/softness of the stator portions 50, 52 is not the only characteristic which may differ between the two stator portions 50, 52. Instead, the first 50 and second 52 stator portions may differ in a wide variety of material properties, including but not limited to lubricity, hardness, temperature resistance (i.e., softening and/or melting point), chemical resistance, crystalline structure, strength, density, elasticity, thermal expansion coefficient, etc. The properties may differ sufficiently such that recognizably different pump characteristics are provided.

The rotor 18 can be made of any of a wide variety of materials, including steel or any of the materials listed above for the stator portions 50, 52. In addition, rather than having a hybrid stator made of more than one material, the rotor 18 may be a "hybrid rotor." In particular, one axial half or portion of the rotor may be made of or coated with a first material 90 (i.e. an elastomeric material) and the second half or portion of the rotor may be coated with or made of a second material (i.e. metal) 92. A hybrid rotor can be manufactured by making standard rotor using common manufacturing techniques while reducing the size of a portion of the rotor (i.e. the portion which will receive the elastomeric coating). The first and second materials of the outer surface of the rotor may have the differing characteristics outlined above for the differing materials of the stator. In this case the hybrid rotor can provide the same or similar benefits as the hybrid stator discussed above. The hybrid rotor can be used in conjunction with a standard (non-hybrid) stator, or in conjunction with a hybrid rotor. FIG. 3 illustrates a hybrid rotor having two sections 90, 92 used in conjunction with a hybrid stator (although the two sections 90, 92 are not shaded differently to show the different types of materials).

Having described the invention in detail and by reference to the preferred embodiments, it will be apparent that modifications and variations thereof are possible without departing from the scope of the invention.

What is claimed is:

1. A progressing cavity pump comprising:

a rotor; and a stator having an inlet, an outlet and an opening, said rotor being rotationally disposed inside said opening such that rotation of said rotor causes fluid in said pump to be pumped from said inlet toward said outlet in a downstream direction, said stator having an inner-most surface defining said opening, said inner-most surface having a first portion made of a first material and a second portion made of a second material, said second material having a material property that differs from said material property of said first portion, said second portion being located in said downstream direction relative to said first portion.

2. The pump of claim 1 wherein said first portion is located at or adjacent to said inlet and said second portion is located at or adjacent to said outlet.

3. The pump of claim 1 wherein said first and second portions directly abut against each other at a transition location such that said inner-most surface is a generally smooth continuous surface entirely from said inlet to said outlet, and wherein said first portion extends from said inlet to said transition location, and wherein said second portion extends from said transition location to said outlet.

4. The pump of claim 3 wherein said transition location is generally located at an axial midpoint of said stator.

5. The pump of claim 3 wherein said first and second portions are non-unitary and are joined together.

6. The pump of claim 5 wherein said first and second portions are mechanically joined together.

7. The pump of claim 1 wherein one of said first or second portion includes a lesser hardness than the other one of said first or second portions.

8. The pump of claim 1 wherein said first portion has a lesser hardness than said second portion.

9. The pump of claim 1 wherein said first portion has a hardness of less than about 85 Shore A and said second portion has a hardness greater than about 25 Rockwell C.

10. The pump of claim 1 wherein said rotor is a helical nut and wherein said inner-most surface is a helical bore.

11. The pump of claim 1 wherein said inner-most surface is a generally smooth continuous surface entirely from said inlet to said outlet.

12. The pump of claim 1 wherein said stator and rotor each have a central axis extending generally parallel to said downstream direction, and wherein said stator and rotor are generally coaxially arranged.

13. The pump of claim 1 wherein said second material is a different material than said first material.

14. The pump of claim 1 wherein said inner-most surface is a two-dimensional surface.

15. A progressing cavity pump comprising:

a rotor; and a stator having an inlet and an outlet, said rotor being rotationally disposed inside said stator such that rotation of said rotor causes fluid in said pump to be pumped from said inlet toward said outlet in a downstream direction, said stator having an inner surface having a first portion made of a first material and a second portion made of a second material, said second portion being located in said downstream direction relative to said first portion wherein said first portion is made of an elastomer, nitrile rubber, natural rubber, synthetic rubber, fluoroelastomer rubber, urethane, ethylene-propylene-diene monomer rubber, polyolefin resin, perfluoroelastomer, hydrogenated nitrile, hydrogenated nitrile rubber, polyurethane, epichlorohydrin polymer, thermoplastic polymer, polytetrafluoroethylene, polychloroprene, synthetic elastomer, polyolefin resin, tetrafluoroethylene/propylene copolymer or acid-olefin interpolymer and wherein said second portion is made of metal, fluorinated hydrocarbon or polymer.

16. A progressing cavity pump comprising:

a rotor; and a stator having an inlet and an outlet, said rotor being rotationally disposed inside said stator such that rotation of said rotor causes fluid in said pump to be pumped from said inlet toward said outlet in a downstream direction, said stator having an inner-most surface defining a central opening receiving said rotor therein, said inner-most surface having a first portion having a material property and a second portion having a material property that differs from said material property of said first portion.

17. The pump of claim 16 wherein said material property is lubricity, hardness, temperature resistance, chemical resistance, crystalline structure, thermal activity, strength, density, elasticity or thermal expansion coefficient.

18. The pump of claim 16 wherein said first and second portions abut against each other at a transition location, and wherein said first portion extends from said inlet to said transition location, and wherein said second portion extends from said transition location to said outlet.

19. The pump of claim 16 wherein said first and second portions are made of different materials.

20. The pump of claim 16 wherein said inner-most surface is a two-dimensional surface.

21. A stator for use with progressing cavity pump comprising a stator body having an inlet and an outlet and an opening sized and shaped to rotationally receive a rotor therein such that rotation of said rotor causes fluid in said stator to be pumped from said inlet toward said outlet in a downstream direction, said stator having an inner-most surface defining said opening, said inner-most surface having a first portion made of a first material and a second portion made of a second material having a material property that differs from said material property of said first material said second portion being located in said downstream direction relative to said first portion.

22. The stator of claim 21 wherein said first portion is located at or adjacent to said inlet and said second portion is located at or adjacent to said outlet.

23. The stator of claim 21 wherein said first and second portions abut against each other at a transition location, and wherein said first portion extends from said inlet to said transition location, and wherein said second portion extends from said transition location to said outlet.

24. The stator of claim 21 wherein one of said first or second portion includes a lesser hardness than the other one of said first or second portions.

25. The stator of claim 21 wherein said first portion has a lesser hardness than said second portion.

26. The stator of claim 21 wherein said second material is a different material than said first material.

27. The stator of claim 21 wherein said inner-most surface is a two-dimensional surface.

28. A stator for use with progressing cavity pump comprising a stator body having an inlet and an outlet and an opening sized and shaped to rotationally receive a rotor therein such that rotation of said rotor causes fluid in said stator to be pumped from said inlet toward said outlet in a downstream direction, said stator having an inner surface defining said opening and having a first portion made of a first material and a second portion made of a second material, said second portion being located in said downstream direction relative to said first portion wherein said first portion is made of an elastomer, nitrile rubber, natural rubber, synthetic rubber, fluoroelastomer rubber, urethane, ethylene-propylene-diene monomer rubber, polyolefin resin, perfluoroelastomer, hydrogenated nitrile, hydrogenated nitrile rubber, polyurethane, epichlorohydrin polymer, thermoplastic polymer, polytetrafluoroethylene, polychloroprene, synthetic elastomer, polyolefin resin, tetrafluoroethylene/propylene copolymer or acid-olefin interpolymer and wherein said second portion is made of metal, fluorinated hydrocarbon or polymer.

29. A progressing cavity pump comprising:

a rotor having an outer surface; and a stator having an inlet and an outlet, said rotor being rotationally disposed inside said stator such that rotation of said rotor causes fluid in said pump to be pumped from said inlet toward said outlet in a downstream direction, said stator having an inner-most surface facing said outer surface of said rotor and defining an opening of said stator one of said outer surface or said inner-most surface having a first portion made of a first material and a second portion made of a second material having a material property that differs from a material property of said first material, said second portion being located in said downstream direction relative to said first portion.

30. The pump of claim 29 wherein said first portion is located at or adjacent to said inlet and said second portion is located at or adjacent to said outlet.

31. The pump of claim 29 wherein said first and second portions abut against each other at a transition location, and wherein said first portion extends from said inlet to said transition location, and wherein said second portion extends from said transition location to said outlet.

32. The pump of claim 29 wherein one of said first or second portion includes a lesser hardness than the other one of said first or second portions.

33. The pump of claim 29 wherein said first portion has a lesser hardness than said second portion.

34. The pump of claim 29 wherein said second material is a different material than said first material.

35. The pump of claim 29 wherein said inner-most surface is a two-dimensional surface.

36. The pump of claim 29 wherein said first portion extends from said inlet to a transition location, and wherein said second portion extends from said transition location to said outlet, and wherein said first and second portions directly abut against each other at said transition location such that said one of said outer or said inner-most surface forms a generally smooth continuous surface entirely from said inlet to said outlet.

37. A progressing cavity pump comprising:

a rotor having an outer surface; and a stator having an inlet and an outlet, said rotor being rotationally disposed inside said stator such that rotation of said rotor causes fluid in said pump to be pumped from said inlet toward said outlet in a downstream direction, said stator having an inner surface facing said outer surface of said rotor, one of said outer surface or said inner surface having a first portion made of a first material and a second portion made of a second material, said second portion being located in said downstream direction relative to said first portion wherein said first portion is made of an elastomer, nitrile rubber, natural rubber, synthetic rubber, fluoroelastomer rubber, urethane, ethylene-propylene-diene monomer rubber, polyolefin resin, perfluoroelastomer, hydrogenated nitrile, hydrogenated nitrile rubber, polyurethane, epichlorohydrin polymer, thermoplastic polymer, polytetrafluoroethylene, polychloroprene, synthetic elastomer, polyolefin resin, tetrafluoroethylene/propylene copolymer or acid-olefin interpolymer and wherein said second portion is made of metal, fluorinated hydrocarbon or polymer.

38. A progressing cavity pump comprising:

a rotor; and a stator having an inlet and an outlet, said rotor being rotationally disposed inside said stator such that rotation of said rotor causes fluid in said pump to be pumped from said inlet toward said outlet in a downstream direction, said stator including two stator portions that are formed separately and joined together, one of said stator portion being located upstream relative to the other stator portion, wherein each stator portion has an inner-most surface defining an opening for receiving said rotor therein, and wherein said inner-most surface of one of said stator portions is made of a material that has at least one material property that differs from the material property of said inner-most surface of the other one of said stator portions.

39. The pump of claim 38 wherein said inner-most surface of said one of said stator portions has a lesser hardness than the other one of said stator portions.

40. The pump of claim 38 wherein said inner-most surfaces of said stator portions are made of different materials.

41. The method of claim 38 wherein said inner-most surface of each stator is a two-dimensional surface.

42. A method for forming a stator comprising the steps of:

providing a first stator portion having an inner-most surface, an inlet and an outlet, said inner-most surface of said first stator portion including a first material;

providing a second stator portion having an inner-most surface, an inlet and an outlet, said inner-most surface of said second stator portion including a second material having a material property that differs from said material property of said first material; and joining said first and second stator portions such that said outlet of said first stator portion is coupled to said inlet of said second stator portion.

43. The method of claim 42 wherein said inner-most surface of said first stator portion has a lesser hardness than said inner-most surface of said second stator portion.

44. The method of claim 42 wherein said inner-most surfaces of said first and second stator portions are made of different materials.

45. The material of claim 42 wherein each inner-most surface is a two-dimensional surface.

* * * * *

UNITED STATES PATENT AND TRADEMARK OFFICE

CERTIFICATE OF CORRECTION

PATENT NO. : 7,214,042 B2
APPLICATION NO. : 10/947703
DATED : May 8, 2007
INVENTOR(S) : Dale H. Perrett It is certified that error appears in the above-identified patent and that said Letters Patent is hereby corrected as shown below:

Column 7

Line 36 – insert -- , -- after "material".

Column 8

Line 16 – insert -- , -- after "stator".

Signed and Sealed this

Seventeenth Day of July, 2007

JON W. DUDAS
*Director of the United States Patent and Trademark Office*